US011552430B2

(12) United States Patent
Rossman

(10) Patent No.: US 11,552,430 B2
(45) Date of Patent: Jan. 10, 2023

(54) GROUND STRUCTURE FOR A CABLE CARD ASSEMBLY OF AN ELECTRICAL CONNECTOR

(71) Applicant: TE Connectivity Services GmbH, Schaffhausen (CH)

(72) Inventor: Jared Evan Rossman, York Haven, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 30 days.

(21) Appl. No.: 17/185,250

(22) Filed: Feb. 25, 2021

(65) Prior Publication Data

US 2022/0271476 A1 Aug. 25, 2022

(51) Int. Cl.

| | |
|---|---|
| ***H01R 13/64*** | (2006.01) |
| ***H01R 13/6471*** | (2011.01) |
| ***H01R 13/6582*** | (2011.01) |
| ***H01R 12/77*** | (2011.01) |
| ***H01R 13/6585*** | (2011.01) |

(52) U.S. Cl.

CPC ..... *H01R 13/6471* (2013.01); *H01R 12/775* (2013.01); *H01R 13/6582* (2013.01); *H01R 13/6585* (2013.01)

(58) Field of Classification Search

CPC ..... H01R 13/6471; H01R 12/775; H01R 13/6582; H01R 13/6585

See application file for complete search history.

(56) References Cited

U.S. PATENT DOCUMENTS

| | | | | |
|---|---|---|---|---|
| 4,767,345 | A * | 8/1988 | Gutter | H01R 13/514 439/594 |
| 6,380,485 | B1 * | 4/2002 | Beaman | H01R 13/6589 439/497 |
| 8,840,432 | B2 * | 9/2014 | Alden, III | H01R 9/0515 439/607.46 |
| 9,203,193 | B2 | 12/2015 | Hackman et al. | |
| 9,437,949 | B2 | 9/2016 | Behziz et al. | |
| 9,825,389 | B2 | 11/2017 | Doye et al. | |
| 10,170,862 | B2 | 1/2019 | Weidner et al. | |
| 11,228,145 | B2 * | 1/2022 | Maesoba | H01R 13/6585 |
| 2018/0115093 | A1 * | 4/2018 | Gross | H01R 24/60 |
| 2022/0140536 | A1 * | 5/2022 | Siev | H01R 13/6463 439/607.01 |
| 2022/0158389 | A1 * | 5/2022 | Pepe | H01R 13/6463 |

* cited by examiner

*Primary Examiner* — Truc T Nguyen

(57) ABSTRACT

A cable card assembly for an electrical connector includes a circuit card having upper and lower surfaces and extending between a cable end and a mating end with mating conductors at the mating end and cable conductors at the cable end. Cables are terminated to the circuit card that include signal conductors, ground shields surrounding the corresponding signal conductors, and drain wires electrically connected to the corresponding ground shields. The signal conductors are terminated to corresponding cable conductors. The cable card assembly includes a ground block separate and discrete from the circuit card and coupled to the circuit card. The ground block includes drain wire channels receiving corresponding drain wires. The ground block is electrically conductive to electrically connect the drain wires.

20 Claims, 3 Drawing Sheets

GROUND STRUCTURE FOR A CABLE CARD ASSEMBLY OF AN ELECTRICAL CONNECTOR

BACKGROUND OF THE INVENTION

The subject matter herein relates generally to electrical connectors.

Electrical connectors are typically used to electrically couple various types of electrical devices to transmit signals between the devices. At least some known electrical connectors include a cable assembly having cables connected between the electrical device and the electrical connector. The cables each have a signal conductor or a differential pair of signal conductors surrounded by a shield layer that, in turn, is surrounded by a cable jacket. The shield layer includes a conductive foil, which functions to shield the signal conductor(s) from electromagnetic interference (EMI) and generally improve performance. A drain wire is provided at the cable core electrically connected to the conductive foil. At an end of the communication cable, the cable jacket, the shield layer, and insulation that covers the signal conductor(s) may be removed (e.g., stripped) to expose the signal conductor(s) and the drain wire. The exposed portions of the signal conductor(s) are then mechanically and electrically coupled (e.g., soldered) to corresponding conductors, such as signal pads of a circuit card. However, termination of the drain wire is problematic. Typically, the drain wire is soldered to a corresponding ground conductor, such as a ground pad of the circuit card or a ground bus. Soldering the drain wires is an extra step in assembly, increasing the assembly time and cost of assembly.

Accordingly, there is a need for an electrical connector having an improved ground structure.

BRIEF DESCRIPTION OF THE INVENTION

In one embodiment, a cable card assembly for an electrical connector is provided including a circuit card having an upper surface and a lower surface. The circuit card has a cable end and a mating end opposite the cable end. The circuit card has mating conductors at the mating end for mating with a mating electrical connector and cable conductors at the cable end. Cables are terminated to the circuit card. The cables include signal conductors, ground shields surrounding the corresponding signal conductors to provide electrical shielding for the signal conductors, and drain wires electrically connected to the corresponding ground shields. The signal conductors are terminated to corresponding cable conductors. The cable card assembly includes a ground block separate and discrete from the circuit card and coupled to the circuit card. The ground block includes drain wire channels receiving corresponding drain wires. The ground block is electrically conductive to electrically connect the drain wires.

In another embodiment, a ground block is provided for a cable card assembly including a circuit card and cables terminated to the circuit card. The ground block includes a main body having a front and a rear extending between an inner end and an outer end opposite the inner end. The inner end is configured to be mounted to the circuit card. The ground block includes separating walls at the inner end forming tunnels. The tunnels are open at the rear to receive signal conductors of the corresponding cables of the cable card assembly. The separating walls provide electrical shielding for the signal conductors in the tunnels. The ground block includes drain wire channels at the outer end. The drain wire channels are configured to receive drain wires of the corresponding cables. The ground block is electrically conductive to electrically connect the drain wires.

In a further embodiment, an electrical connector is provided including a housing having walls forming a cavity. The housing has a mating end at a front of the housing configured to be mated with a mating electrical connector. A cable card assembly is received in the cavity of the housing. The cable card assembly includes a circuit card having an upper surface and a lower surface. The circuit card has a cable end and a mating end opposite the cable end. The circuit card has mating conductors at the mating end for mating with a mating electrical connector and cable conductors at the cable end. Cables are terminated to the circuit card. The cables include signal conductors, ground shields surrounding the corresponding signal conductors to provide electrical shielding for the signal conductors, and drain wires electrically connected to the corresponding ground shields. The signal conductors are terminated to corresponding cable conductors. The cable card assembly includes a ground block separate and discrete from the circuit card and coupled to the circuit card. The ground block includes drain wire channels receiving corresponding drain wires. The ground block is electrically conductive to electrically connect the drain wires.

DETAILED DESCRIPTION OF THE INVENTION

Figure 1:
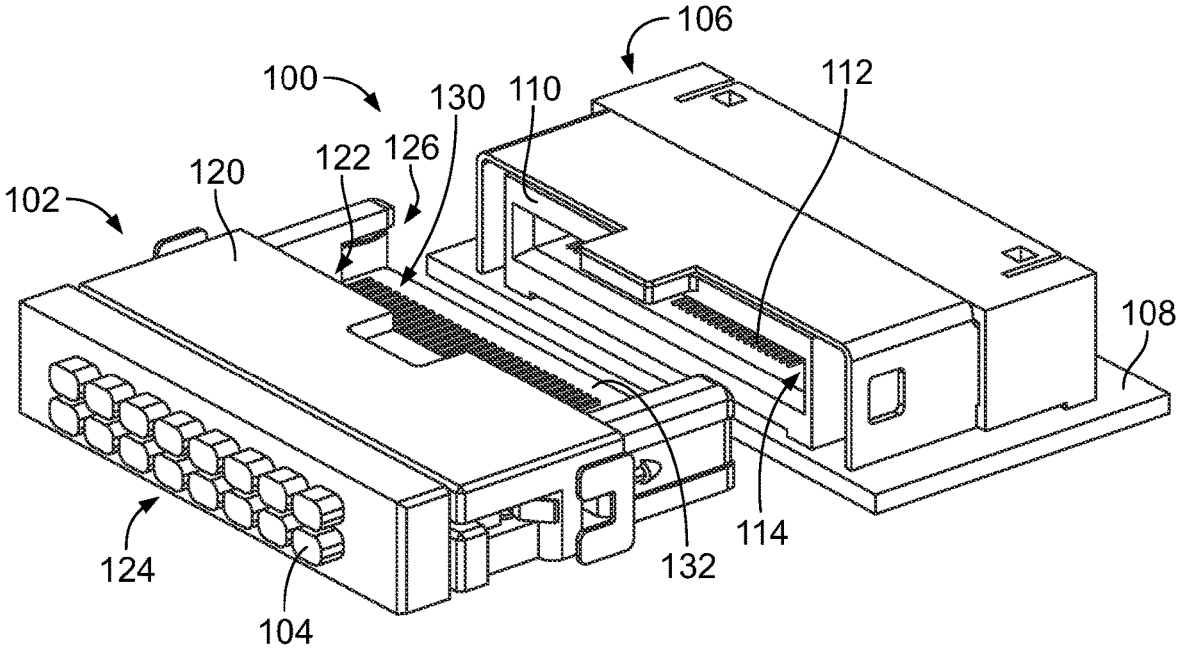
FIG. 1 is a perspective view of a communication system having a plug connector in accordance with an exemplary embodiment.

FIG. 1 is a perspective view of a communication system 100 in accordance with an exemplary embodiment. The communication system 100 includes a first electrical connector 102 provided at ends of cables 104 and a second electrical connector 106 mounted to a circuit board 108. In other various embodiments, the second electrical connector 106 may be provided at ends of cables (not shown). In an exemplary embodiment, the second electrical connector 106 is a receptacle connector, and may be referred to herein after as a receptacle connector 106. The first electrical connector 102 is mated to the second electrical connector 106. In an exemplary embodiment, the first electrical connector 102 is a plug connector configured to be pluggably coupled to the receptacle connector 106. For example, a portion of the plug connector 102 may be plugged into a receptacle of the receptacle connector 106. In an exemplary embodiment, the plug connector 102 is coupled to the receptacle connector 106 at a separable interface. For example, the plug connector 102 is latchably coupled to the receptacle connector 106. The connectors 102, 106 may be input-output (I/O) connectors.

The receptacle connector 106 includes a receptacle housing 110 holding an array of receptacle contacts 112. In an exemplary embodiment, the receptacle housing 110 includes a card slot 114 forming the receptacle receiving the plug connector 102. The receptacle contacts 112 have separable mating interfaces. The receptacle contacts 112 may define a compressible interface, such as including deflectable spring beams that are compressed when the plug connector 102 is received in the card slot 114. Optionally, the receptacle contacts 112 may be arranged in multiple rows along the top and the bottom of the card slot 114. In various embodiments, the receptacle connector 106 is a communication device, such as a card edge socket connector. However, the receptacle connector 106 may be another type of electrical connector in an alternative embodiment, such as a serial attached SCSI (SAS) connector. The receptacle connector 106 may be a high-speed connector that transmits data signals at speeds over 10 gigabits per second (Gbps), such as over 25 Gbps.

The plug connector 102 includes a housing 120 having a cavity 122 that receives a cable card assembly 130. The housing 120 has a cable end 124 and a mating end 126 opposite the cable end 124. The cables 104 extend from the cable end 124. The mating end 126 is configured to be coupled to the receptacle connector 106. The cable card assembly 130 includes a circuit card 132. The cables 104 are configured to be terminated to the circuit card 132. The circuit card 132 is configured to be plugged into the card slot 114 when the plug connector 102 is mated with the receptacle connector 106.

Figure 2:
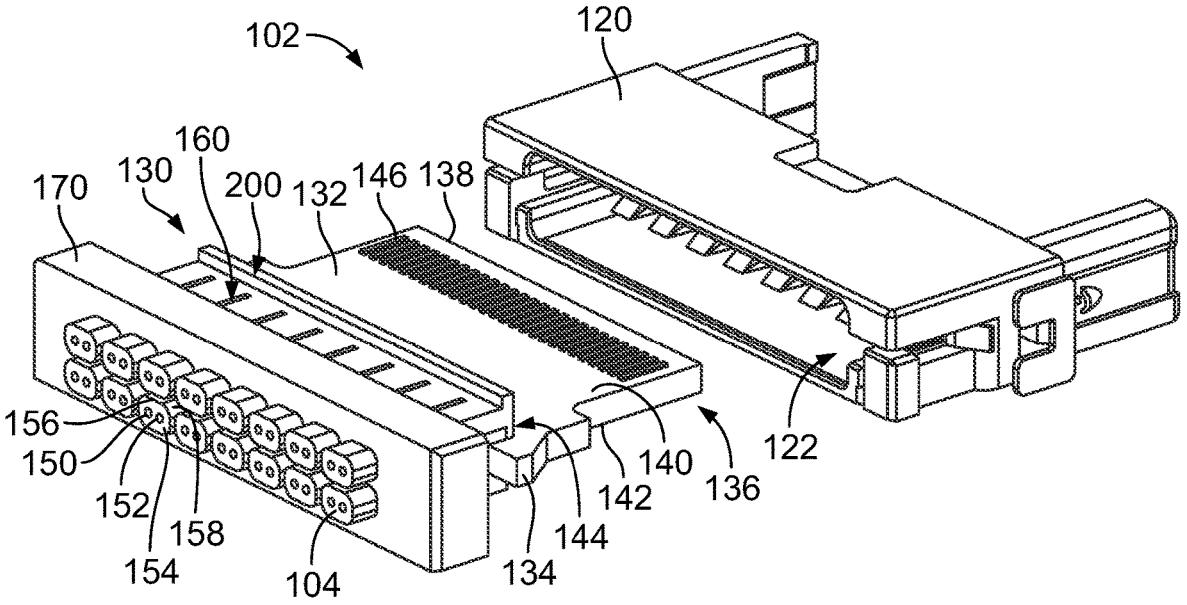
FIG. 2 is an exploded view of the plug connector in accordance with an exemplary embodiment showing a cable card assembly.

FIG. 2 is an exploded view of the plug connector 102 in accordance with an exemplary embodiment. The plug connector 102 includes the housing 120 and the cable card assembly 130. The housing 120 receives the cable card assembly 130 in the cavity 122 to hold the circuit card 132 and the cables 104. In an exemplary embodiment, the cable card assembly 130 includes a ground block 200 separate and discrete from the circuit card 132.

The ground block 200 is coupled to the circuit card 132. The ground block 200 may be electrically connected to the circuit card 132, such as to a ground plane of the circuit card 132. The ground block 200 provides electrical shielding for the signal conductors of the cables 104. The ground block 200 is electrically connected to the shield structures of the cables 104, such as to drain wires of the cables 104. In an exemplary embodiment, the ground block 200 is coupled to the drain wires at solderless connections, such as at interference or press-fit connections. The ground block 200 may be coupled to the circuit card 132 at a solderless connection, such as at an interference or press-fit connection. In various embodiments, multiple ground blocks 200 may be provided, such as at top and bottom sides of the circuit card 132.

The circuit card 132 extends between a cable end 134 and a mating end 136. The circuit card 132 has a card edge 138 at the mating end 136 configured to be plugged into the card slot 114 (shown in FIG. 1) of the receptacle connector 106 (shown in FIG. 1). The circuit card 132 includes an upper surface 140 and a lower surface 142. The circuit card 132 includes cable conductors 144 at the cable end 134 configured to be electrically connected to the signal conductors and shield structure of the cables 104. The cable conductors 144 may be pads or traces of the circuit card 132. The cable conductors 144 may be provided at both the upper surface 140 and the lower surface 142. The circuit card 132 includes mating conductors 146 at the mating end 136 configured to be electrically connected to corresponding receptacle contacts 112 (shown in FIG. 1) of the receptacle connector 106. The mating conductors 146 may be pads or traces of the circuit card 132. The mating conductors 146 may be provided at both the upper surface 140 and the lower surface 142. The mating conductors 146 are provided proximate to the card edge 138.

The cables 104 are terminated to the circuit card 132 at the cable end 134. Each cable 104 includes at least one signal conductor and a shield structure providing electrical shielding for the at least one signal conductor. In an exemplary embodiment, the cables 104 are twin-axial cables. For example, each cable 104 includes a first signal conductor 150 and a second signal conductor 152. The signal conductors 150, 152 carry differential signals. The signal conductors 150, 152 are configured to be terminated to corresponding cable conductors 144 of the circuit card 132. For example, the signal conductors 150, 152 may be soldered to the cable conductors 144. The cable 104 includes an insulator 154 surrounding the signal conductors 150, 152 and a cable shield 156 surrounding the insulator 154. The cable shield 156 provides circumferential shielding around the signal conductors 150, 152. The cable 104 includes a cable jacket 158 surrounding the cable shield 156. In an exemplary embodiment, the cable 104 includes a drain wire 160 electrically connected to the cable shield 156. The drain wire 160 is configured to be electrically connected to the ground block 200.

In an exemplary embodiment, the cable jacket 158, the cable shield 156, and the insulator 154 may be removed (e.g., stripped) to expose the signal conductors 150, 152 and the drain wire 160. The exposed portions of the signal conductors 150, 152 are then mechanically and electrically coupled (e.g., soldered) to the corresponding cable conductors 144. In an exemplary embodiment, the ends of the cables 104 may be surrounded by a strain relief element 170. For example, the strain relief element 170 may be molded or otherwise formed around the cables 104. The strain relief element 170 may be secured to the circuit card 132, such as being molded to the circuit card 132. Optionally, multiple strain relief elements 170 may be provided, such as upper and lower strain relief elements.

During assembly, after the cables 104 are terminated to the circuit card 132 and the ground blocks 200, the cable card assembly 130 may be loaded into the housing 120, such as into a rear of the housing 120. The cable card assembly 130 may be secured in the housing 120 using latches, fasteners or other securing devices.

Figure 3:
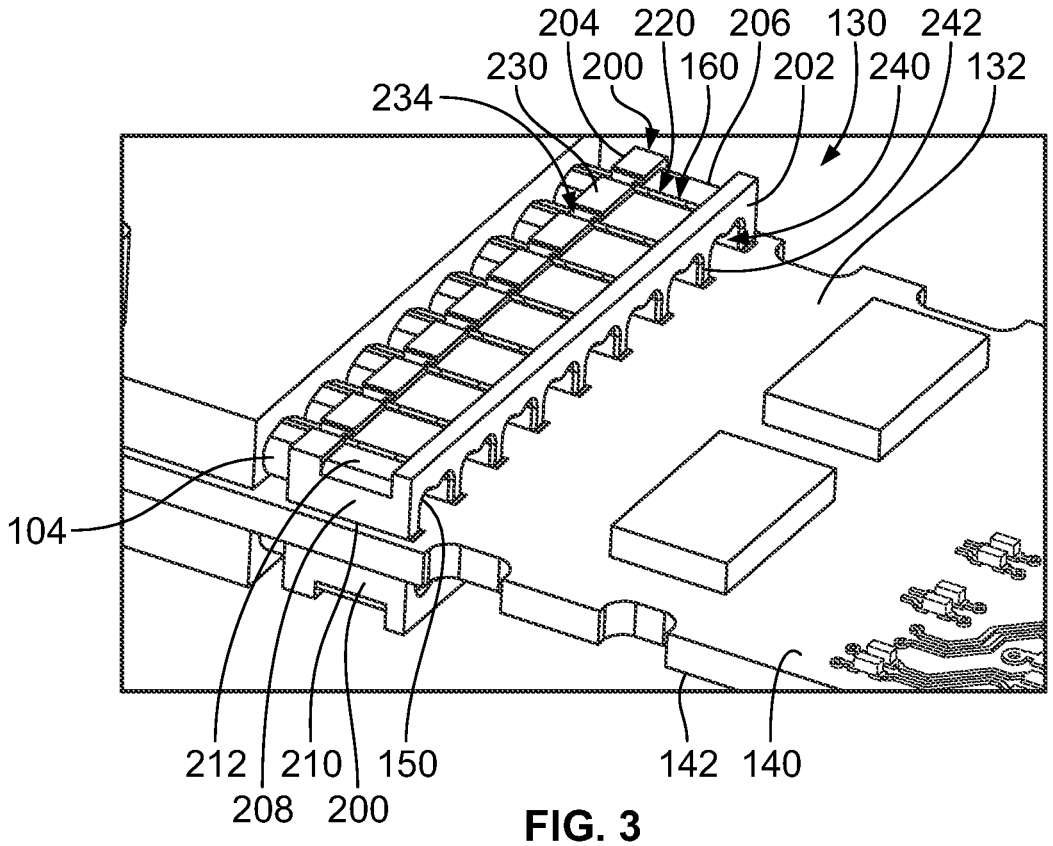
FIG. 3 is a perspective view of a portion of the cable card assembly in accordance with an exemplary embodiment.
Figure 4:
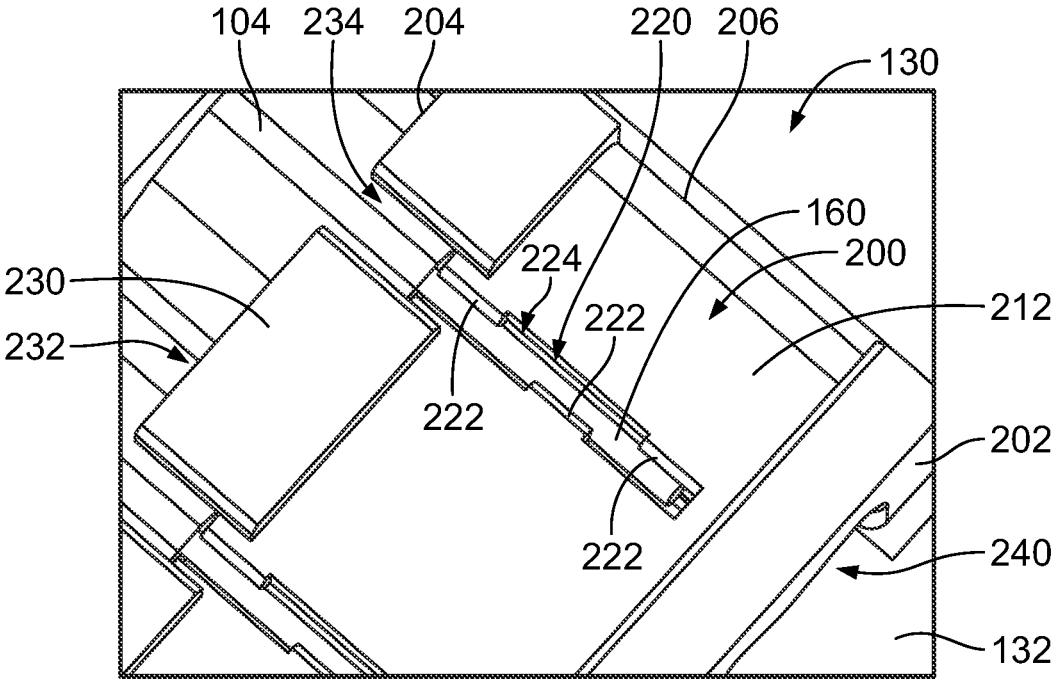
FIG. 4 is a perspective view of a portion of the cable card assembly in accordance with an exemplary embodiment.

FIG. 3 is a perspective view of a portion of the cable card assembly 130 in accordance with an exemplary embodiment. The cable card assembly 130 includes the circuit card 132, the cables 104 terminated to the circuit card 132, and the ground blocks 200 coupled to the circuit card 132. The drain wires 160 of the cables 104 are terminated to the ground blocks 200. FIG. 4 is a perspective view of a portion of the cable card assembly 130 in accordance with an exemplary embodiment showing one of the cables 104 terminated to the ground block 200.

The ground block 200 extends between a front 202 and a rear 204. The cables 104 are located rearward of the ground block 200. For example, ends of the cables 104 face and may abut against the rear 204 of the ground block 200. The ground block 200 includes opposite first and second sides 206, 208. The ground block 200 has a width between the sides 206, 208, which may be approximately equal to the width of the circuit card 132. The ground block 200 has an inner end 210 and an outer end 212 opposite the inner end 210. The inner end 210 faces the circuit card 132. For example, the inner end 210 of the upper ground block 200 is a bottom configured to be mounted to the upper surface 140, while the inner end 210 of the lower ground block 200 is a top configured to be mounted to the lower surface 142. The outer end 212 of the upper ground block 200 is a top while the outer end 212 of the lower ground block 200 is a top configured to be mounted to the lower surface 142.

The ground block 200 includes drain wire channels 220 in the outer end 212. The drain wire channels 220 receive corresponding drain wires 160. In an exemplary embodiment, the drain wires 160 are press-fit into the drain wire channels 220. The drain wires 160 may be held in the drain wire channels 220 by an interference fit. The drain wires 160 are terminated to the ground block 200 by solderless connection in an exemplary embodiment, which reduces assembly time and cost of assembly. In an exemplary embodiment, the drain wire channels 220 are open at the rear 204 to receive the drain wires 160. For example, the drain wires 160 may extend forward from the insulators 154 into the drain wire channels 220. Optionally, the drain wire channels 220 may be open at the outer end 212 to receive the drain wires 160. For example, the drain wires 160 may be loaded into the drain wire channels 220 from above (or below in the case of the ground block on the underside of the circuit card 132).

In an exemplary embodiment, the drain wire channel 220 follows a non-linear path between the rear 204 and the front 202. For example, the ground block 200 includes one or more interference bumps 222 extending into the drain wire channel 220. The ground block 200 may include relief slots 224 opposite the interference bumps 222 to provide space for the drain wire 160. In an exemplary embodiment, the ground block 200 includes interference bumps 222 on both sides of the drain wire channel 220. The drain wire 160 follows a tortuous path through the drain wire channel 220 curving around the interference bumps 222 to create mechanical interference between the drain wire 160 and the ground block 200. The mechanical connection between the drain wire 160 and the ground block 200 electrically commons the ground block 200 with the drain wire 160. In an exemplary embodiment, the ground block 200 is used to electrically common each of the drain wires 160. Optionally, the ground block 200 may include caps (not shown) extending partially across the opening of the drain wire channels 220 to retain the drain wires 160 in the drain wire channels 220.

In an exemplary embodiment, the ground block 200 includes outer walls 230 extending from the rear 204. The outer walls 230 are spaced apart from the circuit card 132 to form a space 232 that receives the ends of the cables 104. Optionally, the outer walls 230 may be spaced apart from each other by openings 234. The openings 234 are aligned with the drain wire channels 220. The drain wires 160 may extend through the openings 234 into the drain wire channels 220.

In an exemplary embodiment, the ground block 200 includes tunnels 240 at the inner end 210. The tunnels 240 are separated by separating walls 242. The separating walls 242 extend from the outer end 212 to the inner end 210. The separating walls 242 extend between the front 202 and the rear 204. The tunnels 240 are open at the rear 204 to receive the signal conductors 150, 152 (shown in FIG. 2) of the cables 104. Optionally, the tunnels 240 may be open at the front 202. Alternatively, the tunnels 240 may be closed at the front 202 by a front wall. The separating walls 242 provide shielding for the signal conductors 150, 152 in the tunnels 240.

Figure 5:
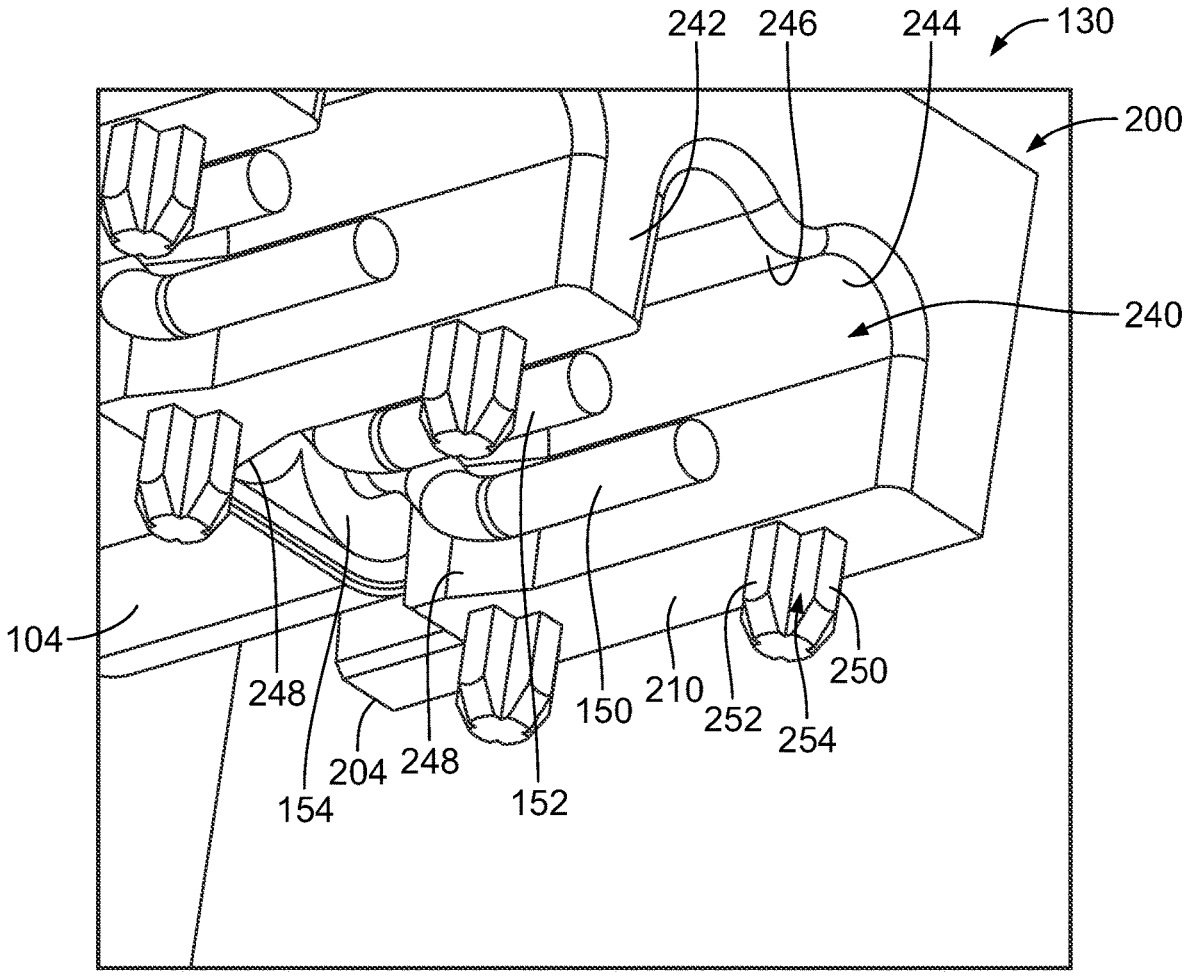
FIG. 5 is a bottom perspective view of a portion of the cable card assembly in accordance with an exemplary embodiment.

FIG. 5 is a bottom perspective view of a portion of the cable card assembly 130 in accordance with an exemplary embodiment showing a portion of the ground block 200 and the corresponding cables 104. The circuit card 132 (shown in FIG. 3) is removed to illustrate the conductors 150, 152 of the cables 104 extending into the tunnels 240 of the ground block 200.

The separating walls 242 provide shielding for the signal conductors 150, 152. The separating walls 242 are spaced apart from the signal conductors 150, 152. Optionally, the separating walls 242 and a connecting wall 244 between the separating walls 242 are shaped and positioned relative to the conductors 150, 152 for impedance control. For example, the separating walls 242 and the connecting wall 244 may maintain a relative constant spacing from both conductors 150, 152. For example, the connecting wall 244 may have a curved impedance rail 246 approximately centered along the connecting wall 244 between the separating walls 242. The impedance rail 246 may be aligned with the gap between the conductors 150, 152. The impedance rail 246 is contoured to maintain the spacing between the connecting wall 244 and the conductors 150, 152 better than if the connecting wall were flat. In an exemplary embodiment, the separating walls 242 include impedance tabs 248 at the rear 204. The impedance tabs 248 are aligned with transition portions of the conductors 150, 152, such as where the conductors 150, 152 exit from the end of the insulator 154 to portions of the conductors 150, 152 that are soldered to the circuit card 232. The impedance tabs 248 are flared inward to locate the ground block 200 closer to the conductors 150, 152 at the transition portions than at the solder portions, where the impedance is lower. The impedance tabs 248 lower the impedance along the transition portions for impedance matching along the conductors 150, 152.

In an exemplary embodiment, the ground block 200 includes mounting pins 250 at the inner end 210. The mounting pins 250 are configured to be coupled to the circuit card 132 (shown in FIG. 2). For example, the mounting pins 250 are configured to be received in plated ground vias of the circuit card 132. In an exemplary embodiment, the mounting pins 250 are press-fit into the ground vias to electrically connect the ground block 200 to the circuit card 132. In an exemplary embodiment, the mounting pins 250 extend from the separating walls 242. Optionally, multiple mounting pins 250 may extend from each separating wall 242 to provide multiple points of mechanical and electrical contact for the ground block 200. In an exemplary embodiment, the mounting pins 250 include press ribs 252 and grooves 254 between the press ribs 252. The press ribs 252 and the grooves 254 extend vertically. The press ribs 252 may be deformed when mating with the plated ground via of the circuit card 132. In an exemplary embodiment, the mounting pins 250 form a solderless connection between the ground block 200 and the circuit card 132. For example, the mounting pins 250 are press fit into the plated vias of the circuit card 132 to create a mechanical and electrical connection between the ground block 200 and the circuit card 132.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable card assembly for an electrical connector comprising:

a circuit card having an upper surface and a lower surface, the circuit card having a cable end and a mating end opposite the cable end, the circuit card having mating conductors at the mating end for mating with a mating electrical connector, the circuit card having cable conductors at the cable end;

cables terminated to the circuit card, the cables including signal conductors, ground shields surrounding the corresponding signal conductors to provide electrical shielding for the signal conductors, and drain wires electrically connected to the corresponding ground shields, the signal conductors having exposed portions at an end of the corresponding cable, the exposed portions being terminated to corresponding cable conductors; and a ground block separate and discrete from the circuit card and being coupled to the circuit card, the ground block covering the exposed portions of the signal conductors to provide shielding for the exposed portions, the ground block including drain wire channels receiving corresponding drain wires, the ground block being electrically conductive to electrically connect the drain wires.

2. The cable card assembly of claim 1, wherein the drain wires are press-fit into the drain wire channels.

3. The cable card assembly of claim 1, wherein the drain wires are electrically connected to the ground block at solderless connections.

4. The cable card assembly of claim 1, wherein the ground block extends between a front and a rear, the rear facing the cables, the ground block having an inner end mounted to the circuit card and an outer end opposite the inner end, the drain wire channels being open at the outer end to receive the drain wires.

5. The cable card assembly of claim 4, wherein the drain wire channels extend between the rear and the front along the outer end, the drain wire channels being open at the rear to receive the drain wires.

6. The cable card assembly of claim 4, wherein the ground block includes tunnels between the rear and the front, the tunnels receiving corresponding signal conductors.

7. The cable card assembly of claim 4, wherein the ground block includes mounting pins extending from the inner end, the mounting pins being coupled to the circuit card.

8. The cable card assembly of claim 7, wherein the circuit card includes ground vias, the mounting pins being press-fit into the ground vias to electrically connect the ground block to the circuit card.

9. The cable card assembly of claim 1, wherein the ground block includes mounting pins received in ground vias of the circuit card, the mounting pins being press-fit into the ground vias to electrically connect the ground block to the circuit card at solderless connections.

10. The cable card assembly of claim 1, wherein the drain wire channels extend along non-linear paths, the drain wires following the non-linear paths.

11. The cable card assembly of claim 1, wherein the ground block includes interference bumps extending into the drain wire channels to engage the drain wires by an interference fit.

12. The cable card assembly of claim 1, wherein the ground block includes tunnels extending between a rear and a front of the ground block, the tunnels being separated by separating walls, each channel receiving a pair of the signal conductors, the separating walls providing electrical shielding between the pairs of the signal conductors.

13. The cable card assembly of claim 12, wherein the separating walls include mounting pins extending therefrom, the mounting pins being press-fit into ground vias of the circuit card to electrically connect the ground block to the circuit card.

14. A ground block for a cable card assembly including a circuit card and cables terminated to the circuit card, the ground block comprising:

a main body having a front and a rear extending between an inner end and an outer end opposite the inner end, the rear facing ends of the cables, the main body having a first side and a second side between the front and the rear and between the inner end and the outer end, the inner end configured to be mounted to the circuit card;

separating walls at the inner end forming tunnels, the tunnels being open at the rear to receive exposed portions of signal conductors of the corresponding cables of the cable card assembly, the separating walls providing electrical shielding for the exposed portions of signal conductors in the tunnels; and drain wire channels at the outer end, the drain wire channels configured to receive drain wires of the corresponding cables, the ground block being electrically conductive to electrically connect the drain wires.

15. The ground block of claim 14, wherein the drain wire channels are open at the outer end and at the rear to receive the drain wires.

16. The ground block of claim 14, wherein the ground block includes mounting pins extending from the separating walls at the inner end, the mounting pins configured to be press fit into ground vias of the circuit card to electrically connect the ground block to the circuit card.

17. The ground block of claim 14, wherein the drain wire channels extend along non-linear paths, the drain wires following the non-linear paths.

18. The ground block of claim 14, wherein the ground block includes interference bumps extending into the drain wire channels to engage the drain wires by an interference fit, the interference bumps forming non-linear paths through the drain wire channels.

19. An electrical connector comprising:

a housing having walls forming a cavity, the housing having a mating end at a front of the housing configured to be mated with a mating electrical connector; and a cable card assembly received in the cavity of the housing, the cable card assembly including a circuit card, cables terminated to the circuit card, and a ground block coupled to the circuit card, the circuit card having an upper surface and a lower surface, the circuit card having a cable end and a mating end opposite the cable end, the circuit card having cable conductors at the cable end, the circuit card having mating conductors at the mating end of the circuit card, the mating end of the circuit card configured to be plugged into a card slot of the mating electrical connector, the cables including signal conductors, ground shields surrounding the corresponding signal conductors to provide electrical shielding for the signal conductors, and drain wires electrically connected to the corresponding ground shields, the signal conductors having exposed portions at an end of the corresponding cable being terminated to corresponding cable conductors, the ground block covering the exposed portions of the signal conductors to provide shielding for the exposed portions, the ground block including drain wire channels receiving corresponding drain wires, the ground block being electrically conductive to electrically connect the drain wires.

20. The electrical connector of claim 19, wherein the drain wires are press-fit into the drain wire channels.

* * * * *